US008057123B2

(12) United States Patent
Monneret

(10) Patent No.: US 8,057,123 B2
(45) Date of Patent: Nov. 15, 2011

(54) DEVICE FOR A PAVEMENT MANHOLE WITH A SUPPORT FRAME FOR CLOSING A PANEL HINGED ON THE FRAME USING PERMANENT ARTICULATION MEANS

(75) Inventor: Jean-Jacques Monneret, Lyons (FR)

(73) Assignee: Norinco, Ibouvillers (FR)

( * ) Notice: Subject to any disclaimer, the term of this patent is extended or adjusted under 35 U.S.C. 154(b) by 0 days.

(21) Appl. No.: 12/513,585

(22) PCT Filed: Oct. 31, 2007

(86) PCT No.: PCT/FR2007/052293

§ 371 (c)(1),
(2), (4) Date: Feb. 4, 2010

(87) PCT Pub. No.: WO2008/087307

PCT Pub. Date: Jul. 24, 2008

(65) Prior Publication Data

US 2010/0178105 A1 Jul. 15, 2010

(30) Foreign Application Priority Data

Nov. 6, 2006 (FR) ..... 06 54742

(51) Int. Cl.
*E05D 7/10* (2006.01)

(52) U.S. Cl. ..... 404/25; 16/255; 16/256; 403/327

(58) Field of Classification Search ..... 16/255, 16/256, 258; 404/25; 403/327, 378
See application file for complete search history.

(56) References Cited

U.S. PATENT DOCUMENTS 3,712,248 A * 1/1973 Floehr ..... 105/253
3,994,520 A * 11/1976 Oger ..... 292/256.73
5,692,855 A * 12/1997 Burton ..... 403/325
5,864,990 A * 2/1999 Tu ..... 52/19
6,446,307 B2 * 9/2002 Wilkins ..... 16/325

(Continued)

FOREIGN PATENT DOCUMENTS

DE 20310536 9/2003

(Continued)

OTHER PUBLICATIONS

International Search Report (PCT/ISA/210).

(Continued)

*Primary Examiner* — Gary S Hartmann
(74) *Attorney, Agent, or Firm* — Warner Norcross & Judd LLP

(57) ABSTRACT

The present invention relates to a device for a pavement manhole with a support frame, for closing a panel hinged on the frame using permanent articulation means. The device is characterized in that the pivot axis (8) includes a pin made of at least two parts (13, 14) telescopically mounted into each other and spaced from each other by a spring (15) provided between the two telescopic parts (13, 14) so as to engage and hold the two ends of the pin (8) respectively in two blind holes (20) of the frame. The invention can be used in road equipment.

9 Claims, 4 Drawing Sheets

U.S. PATENT DOCUMENTS

| | | | | |
|---|---|---|---|---|
| 6,588,810 | B1 * | 7/2003 | Monneret | 292/200 |
| 6,739,796 | B1 * | 5/2004 | Del Nero et al. | 404/25 |
| 6,749,363 | B1 | 6/2004 | Petersen | |
| 6,866,442 | B1 * | 3/2005 | Petersen | 403/326 |
| 6,957,927 | B1 | 10/2005 | Petersen | |
| 7,243,515 | B2 * | 7/2007 | Meyer | 70/269 |
| 7,320,236 | B2 * | 1/2008 | Monneret et al. | 70/169 |
| 7,341,398 | B2 * | 3/2008 | Johnson et al. | 404/25 |
| 7,704,010 | B2 * | 4/2010 | Nolle et al. | 404/25 |
| 7,726,378 | B1 * | 6/2010 | Savon | 160/201 |
| 7,753,610 | B2 * | 7/2010 | Gehrke | 403/109.3 |
| 7,832,958 | B2 * | 11/2010 | Veldboom et al. | 404/25 |
| 7,896,574 | B2 * | 3/2011 | Nolle et al. | 404/25 |
| 2004/0234332 | A1 * | 11/2004 | Burgstaler et al. | 403/327 |
| 2005/0244227 | A1 | 11/2005 | Akkala et al. | |

FOREIGN PATENT DOCUMENTS

| | | |
|---|---|---|
| FR | 2713256 | 6/1995 |
| GB | 2390629 | 1/2004 |

OTHER PUBLICATIONS

Written Opinion of the International Searching Authority (PCT/ISA/237).

* cited by examiner

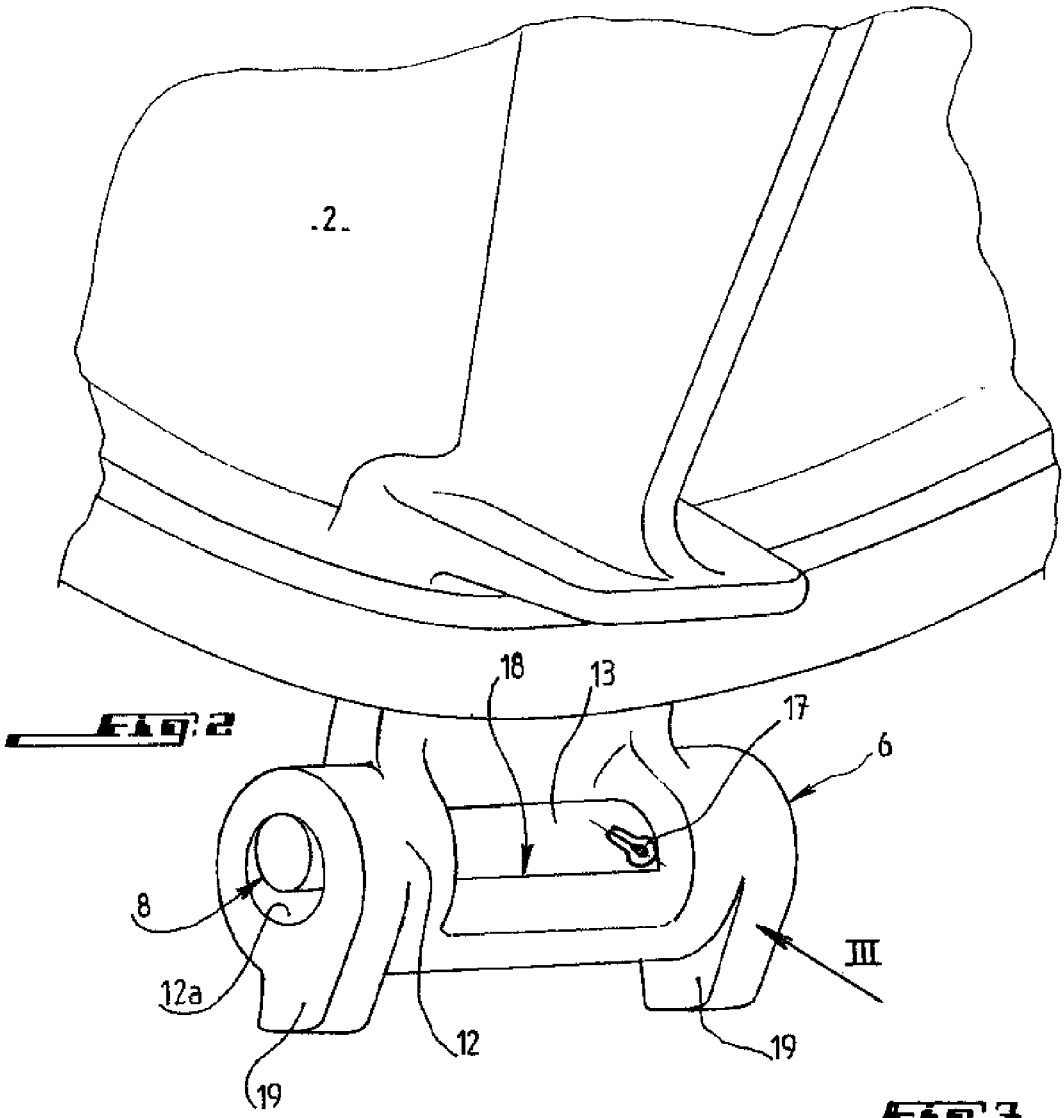
Fig. 2
Fig. 3
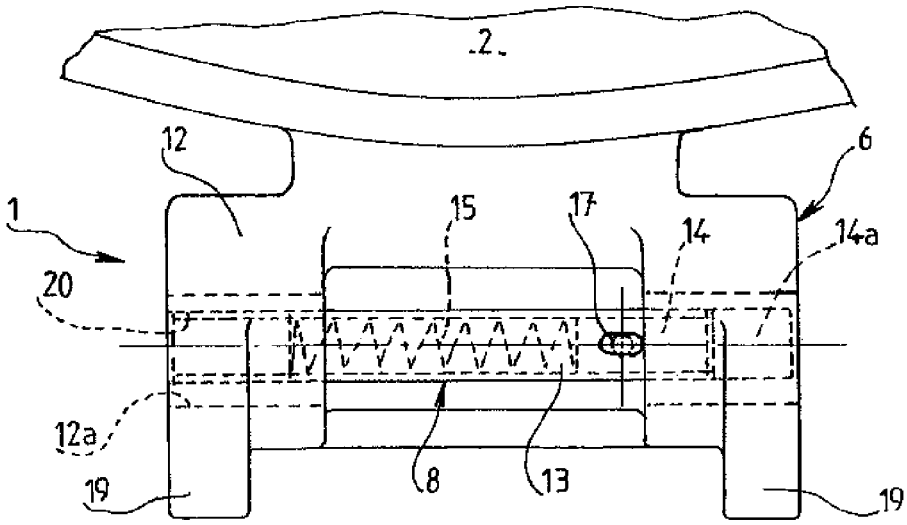

DEVICE FOR A PAVEMENT MANHOLE WITH A SUPPORT FRAME FOR CLOSING A PANEL HINGED ON THE FRAME USING PERMANENT ARTICULATION MEANS

The present invention relates to a device for closing an opening, comprising a frame and at least one hinged panel of the type of those which form roadway equipment giving access for example to manholes buried in the ground.

Such a device is known, according to which the permanent articulation means of the panel relatively to the frame comprise a protruding tenon at the periphery of the panel and adapted in order to engage into a housing provided in a skirt of the frame and a pivot axis extending transversely in the tenon of the panel and the housing of the frame in order to allow the panel to pivot between a lowered position for closing the frame and a raised position for accessing the opening of the frame.

The frame is sealed in the ground at the upper end of the manhole shaft, by concrete which embeds the sole of the frame.

The pivot or articulation axis of the panel to the frame is generally formed by a bolt passing through both side walls of the housing of the frame and by the tenon of the panel engaged into this housing, the head and nut for attachment of the bolt being tightened by bearing upon the external faces of both sidewalls of the housing of the frame respectively.

Such articulation means pose a problem upon installing the panel to the frame.

Indeed, in order to allow engagement of the articulation bolt through the side walls of the housing of the frame and the tenon of the panel engaged in this housing, it is necessary beforehand to break the portion of the sealing concrete of the sole of the frame surrounding the side walls of the housing and then, once the articulation bolt is installed, to again fill with concrete the cleared portion around the opening of the frame.

The object of the present invention is to solve the above problem of the known closing devices.

For this purpose, according to the invention, the device for closing a pavement manhole, comprising a frame, at least one panel adapted to as to be borne by the frame, and permanent articulation means of the panel relatively to the frame, the articulation means comprising a protruding tenon at the periphery of the panel and adapted in order to engage into a housing provided in a skirt of the frame and a pivot axis extending transversely in the tenon of the panel and the housing of the frame, is characterized in that the pivot axis comprises a pin consisting of at least two parts telescopically mounted into each other and axially spaced from each other by a spring positioned between both telescopic parts so as to engage and hold the two ends of the pivot pin in two blind holes of the frame, respectively.

Advantageously, both blind holes are respectively formed in two side walls delimiting the housing of the tenon of the panel.

Before placing the articulation means in the housing of the frame, both telescopic parts of the pin are held in a retracted position, or sunken coaxially into each other against the return force of the spring by a cotter pin passing through both telescopic parts and which may be removed when the tenon of the panel provided with the pin is engaged into the housing of the frame so that both telescopic parts may move axially away from each other by the action of the spring in order to engage their ends in both blind holes of the frame.

The length of both parts retracted into each other of the pin is substantially equal to the height of the tenon of the panel.

The tenon of the panel comprises at least one recessed portion along its width in order to allow introduction of the pin, the telescopic parts of which are retracted into each other, in the tenon along a direction transverse to the latter.

The cotter pin for retaining both telescopic parts of the pin protrudes from the recessed portion of the tenon.

The spring is advantageously a compression coil spring housed in the external tubular portion of both telescopic parts and an end turn of which bears upon the bottom of the tubular portion and the opposite end turn bears upon the end of the telescopically internal part.

The invention is also directed to a pin intended to form a permanent articulation between a panel and a support frame of the panel through a pavement manhole and which is characterized in that it comprises two parts telescopically mounted into each other and occupying a position wherein they are retracted in each other against the return force of a compression coil spring positioned between both telescopic parts which are held in this position by a cotter pin passing through both telescopic parts.

The invention is finally directed to a method for installing a panel, such as a plug or a grid, with a hinged and permanent mounting on a support frame, as defined earlier, and which is characterized in that it consists of housing the pin, both telescopic parts of which are held in a position wherein they are retracted in each other by the cotter pin, in the tenon through the latter, of engaging the tenon and pin into the housing of the frame and removing the cotter pin so that the spring moves both telescopic parts axially away from each other in order to engage their ends in both blind holes of the frame, respectively.

The invention will be better understood and other objects, features, details and advantages thereof will become more clearly apparent in the explanatory description which follows, made with reference to the appended drawings exclusively given as an example illustrating an embodiment of the invention and wherein:

FIG. 2 is an enlarged bottom perspective view of the panel with a articulation tenon according to the invention;

FIG. 3 is a front view along the arrow III of the tenon of FIG. 2;

Figure 1:
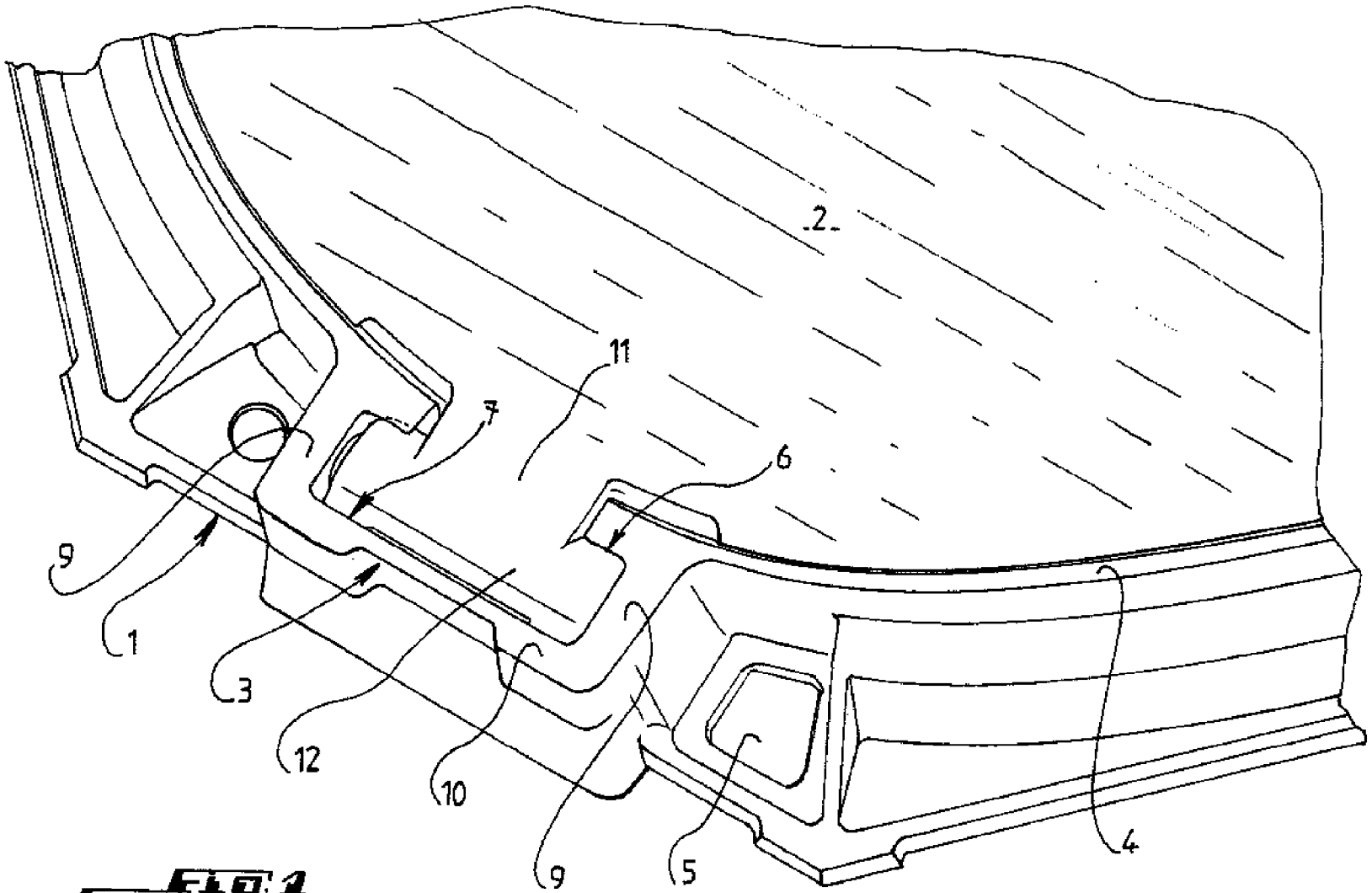
FIG. 1 is a top view of a piece of roadway equipment with a frame for supporting a panel in the closed position hingedly mounted to the frame by articulation means according to the invention.
Figure 4:
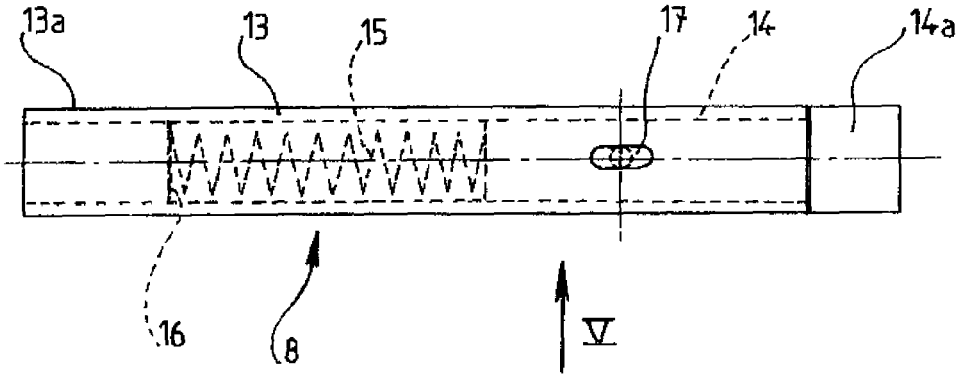
FIG. 4 is a side view of an articulation pin, in the position ready for allowing the tenon of the panel to be installed in the corresponding housing of the frame.
Figure 5:
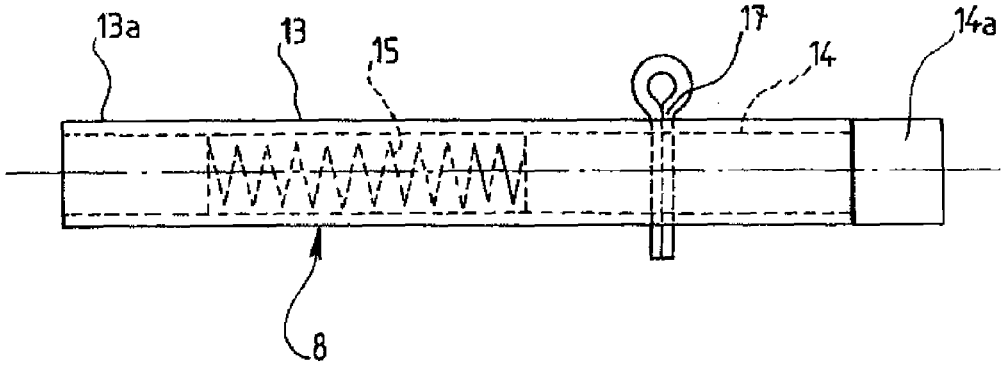
FIG. 5 is a side view along the arrow V of the pin of FIG. 4.
Figure 6:
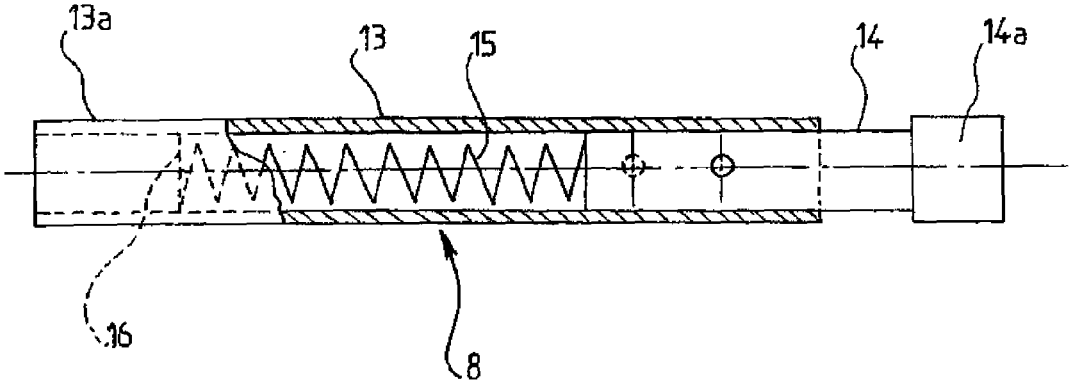
FIG. 6 is a view with partial removal of the articulation pin occupying its active position for retaining the tenon of the panel in the corresponding housing of the frame.
Figure 7:
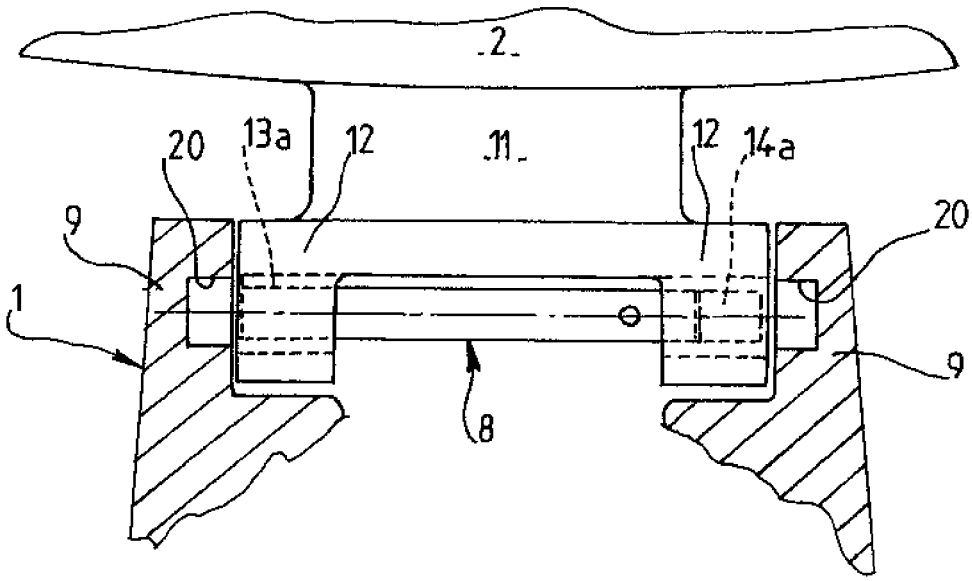
FIG. 7 illustrates the tenon and pin assembly installed in the corresponding housing of the frame with the pin in its inactive position.
Figure 8:
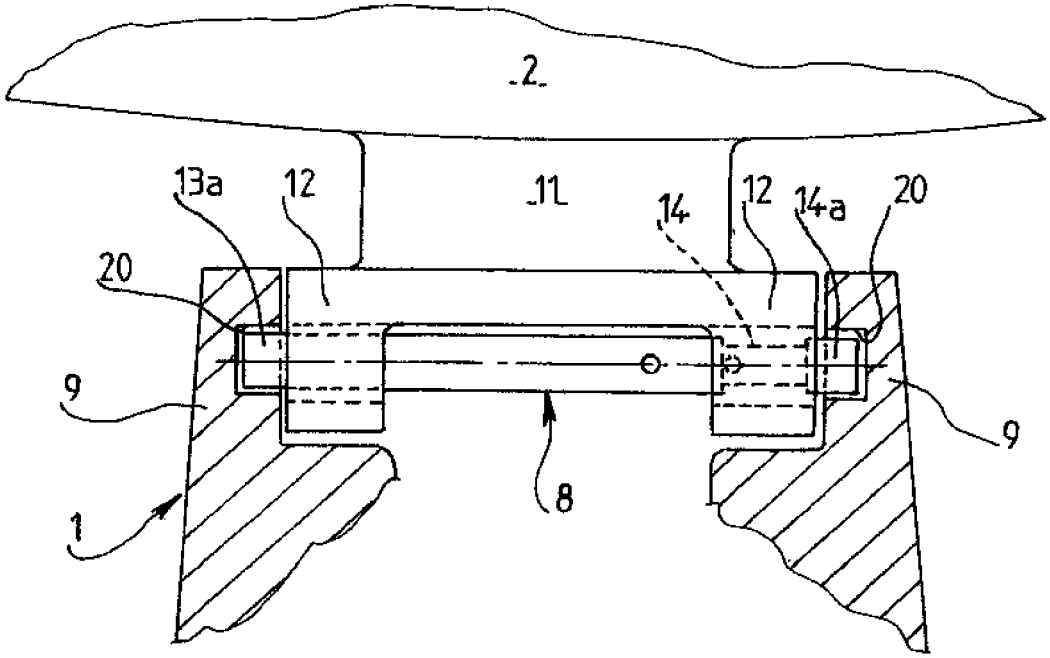
FIG. 8 is a view similar to the one of FIG. 7 and illustrating the pin caused to be confined in the frame after removing a cotter pin.

The device as illustrated in the figures comprises a frame 1 which may be sealed in the ground at the upper end of a manhole or shaft and a panel 2, such as a plug or a grid, bound to the frame 1 in a permanent way by articulation means forming a hinge 3 by which the panel 2 may tilt over from a position for closing the opening of the frame 1 at which the panel is inserted in thickness into a skirt 4 of the frame 1 and to a raised position for accessing the opening of the frame 1 delimited by the skirt 4.

The frame 1 and the panel 2 are illustrated as having a circular general shape, but they may have a rectangular general shape.

The frame 1 is provided at its outer periphery with a sole 5 allowing the frame 1 to be sealed in the ground by concrete.

The articulation means 3 comprise a protruding tenon 6 at the external periphery of the panel 2 and adapted in order to engage into a conjugate housing 7 provided in the skirt 4 of the frame 1 and a pivot axis 8 extending transversely in the tenon 6 and the housing 7 of the frame 1, a housing which is delimited in a casing protruding from the outer periphery of the skirt 4 of the frame and including two side walls 9 between which the pivot axis 8 is transversely positioned and a distal wall 10 transversely connected to the side walls 9.

The tenon 6 of the panel 2 and the housing 7 respectively have approximately two T shapes complementary to each other, but it is a matter of fact that this shape is non-limiting.

Thus, the tenon 6 includes a portion 11 extending radially from the panel 2 and corresponding to the leg of the T and a portion with a cylindrical general shape 12 corresponding to the transverse bar of the T. The transverse portion 12 has a length somewhat smaller than the distance between both opposite internal faces of both side walls 9 of the housing 7.

According to the invention, the articulation axis 8 is formed by a cylindrical pin comprising two parts telescopically engaged into each other, respectively a tubular external part 13 and an internal part 14 which may slide coaxially in the part 13 so as to move axially away from the part 13 under the action of a compression coil spring 15 housed in the part 13 while having one of its end turns bearing upon a bottom wall 16 of the tubular part 13 and its opposite end turn bearing upon the end of the sliding part 14 housed in the part 13 of the pin 8.

The sliding part 14 of the pin 8 ends opposite to its end in contact with the spring 15 with a portion of a larger diameter 14*a* substantially equal to the external diameter of the tubular part 13.

In the inactive position of the pin 8, the sliding part 14 is sunken into the tubular part 13 by compressing the spring 15 and is held in this position by a cotter pin 17 passing through both parts 13, 14 of the pin 8. In this sunken-in position of the part 14 in the part 13, the larger diameter portion 14*a* of the part 14 bears upon the corresponding end of the tubular part 13.

As this is better visible in FIG. 2, the cylindrical portion 12 of the tenon 6 is partly recessed as indicated in 18 along its longitudinal direction, i.e. transverse to the width of the tenon 6, so as to form a window into which the pin 8 may be engaged, both parts 13, 14 of which are maintained sunken into each other by the cotter pin 17. In this sunken-in position of the parts 13, 14, the pin 8 has a length substantially equal to the length of the cylindrical portion 12 of the tenon 6, the pierced through-hole 12*a* has a diameter slightly larger than the external diameter of the tubular portion 13 of the pin 8.

The installation of the articulation hinge connecting the panel to the frame is carried out as follows.

First of all, the pin 8, both parts 13, 14 of which are held sunken into each other by the cotter pin 17, is introduced into the through-hole 12*a* of the cylindrical portion of the tenon 6 through the recessed portion 18 so that the free ends of the pin 8 do not protrude from either side of the tenon 6.

Next, the panel 2 is placed relatively to the frame 1 in a raised position and the tenon 6 is engaged into the housing 7 of the frame 1. Holding the panel 2 in the raised position relatively to the frame 1 may be ensured by two axially spaced-out lugs 19 radially protruding from the cylindrical portion 12 of the tenon 6 and which will abut upon respective supporting surfaces of the frame 1, as this is known per se.

Next, the cotter pin 17 is removed from the pin 8 and the spring 15 exerts on the part 14 a force which makes it slide in a direction, moving it away from the part 13 so that both free ends 13*a* and 14*a* of the parts 13 and 14 of the pin 8 may respectively engage into two coaxial blind holes 20 formed in both side walls 9 of the housing 7. In this way, the pin 8 is held confined in the housing 7 while being practically invisible from the outside because the tenon 6 is housed in the housing 7 with very small play.

Thus, the placement of the articulation means of the invention connecting the panel 2 to the frame 1 may be carried out without breaking the material, such as concrete, sealing the sole 5 of the frame 1 in the ground by surrounding the side walls 9 of the housing 7 since the ends of the pin 8 may be housed in both blind holes 20 formed in both of these side walls 9.

Of course, the invention may be applied to roadway equipment including several panels, each hingedly mounted to the frame by the articulation means described above. Although this is more complicated from the structural point of view, the pin may consist of three portions, a central tubular portion and two opposite portions respectively slidably mounted in both end portions of the central portion with interposition of a spring between both sliding portions which are, in the inactive position of the pin, sunken into the central tubular portion and retained in this position by two cotter pins accessible from the outside, one passing through the central tubular portion and one of the sliding portions while the other one passes through the central position and the other sliding end portion. By removing both cotter pins, both sliding end portions move away from each other in order to be engaged into both blind holes of both side walls delimiting the housing 7 of the tenon 6 of the panel.

The invention claimed is:

1. A closing device for a pavement manhole, comprising a frame, at least one panel adapted for being borne by the frame and permanent articulation means of the panel relatively to the frame, the articulation means having a protruding tenon at the periphery of the panel and adapted so as to engage into a housing provided in a skirt of the frame and a pivot axis extending transversely in the tenon of the panel and the housing of the frame, wherein the pivot axis includes a pin having at least two parts telescopically mounted in each other and spaced axially apart from each other by a spring positioned between both telescopic parts so as to engage and hold both ends of the pivot pin in two blind holes of the frame, respectively.

2. The device according to claim 1, wherein both blind holes are respectively formed in two side walls delimiting the housing of the tenon of the panel.

3. The device according to claim 1, wherein before placing the articulation means in the housing of the frame, both telescopic parts of the pin are held in a retracted position or sunken coaxially into each other against the return force of the spring by a cotter pin passing through both telescopic parts and which may be removed when the tenon of the panel provided with the pin is engaged into the housing of the frame so that both telescopic parts may move axially away from each other by the action of the spring in order to engage their ends in both blind holes of the frame.

4. The device according to claim 3, wherein the length of both parts retracted into each other of the pin is substantially equal to the width of the tenon of the panel.

5. The device according to claim 3, wherein the tenon of the panel includes at least one recessed portion along its width so as to allow the pin, the telescopic parts of which are retracted into each other, to be introduced into the tenon along a direction transverse to the latter.

6. The device according to claim 5, wherein the cotter pin for retaining both telescopic parts of the pin protrudes from the recessed portion of the tenon.

7. The device according to claim 1, wherein the spring is a compression coil spring housed in the external tubular part of both telescopic parts and an end turn of which bears upon the bottom of the tubular part and the opposite end turn bears upon the end of the telescopically internal part.

8. A method for installing a panel, hingedly and permanently mounted on a support frame for a closing device as defined in claim 1, wherein the method includes the steps of housing the pin, both telescopic parts of which are held in a position wherein they are retracted into each other by a cotter pin in the tenon through the latter, engaging the tenon and the pin into the housing of the frame and removing the cotter pin so that the spring moves both telescopic parts axially away from each other in order to engage their ends in both blind holes of the frame, respectively.

9. A pin adapted to form a permanent articulation between a panel and a support frame of the panel for a pavement manhole, wherein the pin includes two parts telescopically mounted into each other and occupying a position wherein they are retracted in each other against the return force of a compression coil spring positioned between both telescopic parts which are held in this position by a cotter pin passing through both telescopic parts, the compression coil spring being located in a tubular external part of the telescopic parts, and one end of the compression coil spring bearing upon a bottom wall of the tubular external part and its opposite end bearing upon one end of a sliding part of the telescopic parts housed in the tubular external part.

* * * * *